US008076834B2

(12) United States Patent
Fennimore et al.

(10) Patent No.: US 8,076,834 B2
(45) Date of Patent: Dec. 13, 2011

(54) FIELD EMISSION DEVICE WITH PROTECTING VAPOR

(75) Inventors: Adam Fennimore, Wilmington, DE (US); David Herbert Roach, Hockessin, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 32 days.

(21) Appl. No.: 12/673,586

(22) PCT Filed: Aug. 20, 2008

(86) PCT No.: PCT/US2008/073638

§ 371 (c)(1),
(2), (4) Date: Feb. 16, 2010

(87) PCT Pub. No.: WO2009/026314

PCT Pub. Date: Feb. 26, 2009

(65) Prior Publication Data

US 2011/0101859 A1 May 5, 2011

Related U.S. Application Data

(60) Provisional application No. 60/957,502, filed on Aug. 23, 2007.

(51) Int. Cl.
*H01J 29/94* (2006.01)
*H01J 9/395* (2006.01)

(52) U.S. Cl. ..... 313/495; 313/309; 313/336; 313/351; 445/23; 445/38

(58) Field of Classification Search ..... None
See application file for complete search history.

(56) References Cited

U.S. PATENT DOCUMENTS

| | | | | |
|---|---|---|---|---|
| 6,722,936 | B2 | 4/2004 | Hammel | |
| 6,888,294 | B1 | 5/2005 | Meyer et al. | |
| 7,258,590 | B2 * | 8/2007 | Oyama et al. | 445/50 |
| 2002/0074932 | A1 | 6/2002 | Bouchard et al. | |
| 2004/0036401 | A1 * | 2/2004 | Konuma et al. | 313/311 |
| 2005/0090176 | A1 * | 4/2005 | Dean et al. | 445/51 |
| 2005/0134161 | A1 * | 6/2005 | Kitamura et al. | 313/309 |
| 2006/0049741 | A1 * | 3/2006 | Bouchard et al. | 313/495 |
| 2006/0214560 | A1 * | 9/2006 | Noguchi et al. | 313/498 |

FOREIGN PATENT DOCUMENTS

WO 2005/045871 5/2005

* cited by examiner

*Primary Examiner* — Ashok Patel

(57) ABSTRACT

A field emission device in which a protecting vapor is present in an evacuated space between a field emission cathode assembly and an anode. The protecting vapor may be one or more hydrogen-containing gases such as a gas containing M—H bonds where M may be C, Si, B, Al or P.

10 Claims, 6 Drawing Sheets

FIELD EMISSION DEVICE WITH PROTECTING VAPOR

This application claims priority under 35 U.S.C. §119(e) from, and claims the benefit of, U.S. Provisional Application No. 60/957,502, filed 23 Aug. 2007, which is by this reference incorporated in its entirety as a part hereof for all purposes.

TECHNICAL FIELD

This invention relates to a field emission device, and the use therein of a protecting vapor to reduce degradation of emission current strength.

BACKGROUND

This invention addresses the lifetime/lifespan that is seen in field emission devices, in particular those that employ carbon nanotubes as the active field emitters. Short lifetime in a field emission device is one of the chief obstacles that must be overcome for the device to be a viable contender in the marketplace. By applying sufficient potential to the anode ($V_A$) of a field emission diode device, or to the gate electrode ($V_G$) of a field emission triode device, an emission current will be caused to flow. As the emitters degrade, a greater potential must be applied to maintain a constant emission current. The rate of increase of this applied potential is a good indicator of the degradation rate of the emitters and what the lifespan of a particular device might be. From the rate of increase of the applied potential, an extrapolation can be made of how long it will take for the potential to reach the upper bound of what is possible to supply in a particular device. For applications such as field emission displays, it is desired that the lifespan of the device be at least 30,000 hours. A significant percentage of field emission devices, particularly nanotube-based devices, have been unable to demonstrate lifespans on this scale.

U.S. Pat. No. 6,888,294 discloses a field emission device which contains a nitrogen hydride reducing gas for preventing emissive material oxidation, particularly where molybdenum emitters are used. U.S. Pat. No. 6,722,936 discloses a field emission device where carbon field emitters are deposited on heated areas through introduction of hydrocarbons prior to evacuation of the device. WO 05/45871 discloses a field emission device comprising a coating layer formed on an outer surface of a carbon nanotube.

A need nevertheless remains for methods to enhance the lifespan of a field emission device, and for the improved devices resulting from the employment of such methods.

BRIEF DESCRIPTION OF THE DRAWINGS

Various features and/or embodiments of this invention are illustrated in drawings as described below. These features and/or embodiments are representative only, and the selection of these features and/or embodiments for inclusion in the drawings should not be interpreted as an indication that subject matter not included or described in the drawings is not suitable for practicing the invention, or that subject matter not included or described in the drawings is excluded from the scope of the appended claims and equivalents thereof.

SUMMARY

The invention disclosed herein includes methods for improving the performance of field emission devices, including the use of such methods, and also including improved field emission devices as are obtained or obtainable from such methods.

Features of certain of the methods and devices of this invention are described herein in the context of one or more specific embodiments that combine various such features together. The scope of the invention is not, however, limited by the description of only certain features within any specific embodiment, and the invention also includes (1) a subcombination of fewer than all of the features of any described embodiment, which subcombination may be characterized by the absence of the features omitted to form the subcombination; (2) each of the features, individually, included within the combination of any described embodiment; and (3) other combinations of features formed by grouping only selected features of two or more described embodiments, optionally together with other features as disclosed elsewhere herein.

One of the specific embodiments of the methods disclosed herein provides a method for increasing the lifespan of a field emission device by (a) providing a field emission device that includes (i) a cathode assembly, (ii) an anode, and (iii) an evacuated space between the cathode assembly and the anode; and (b) supplying to the evacuated space a protecting vapor having, within the evacuated space, a partial pressure greater than about $10^{-8}$ Torr at 20° C.

One of the specific embodiments of the field emission devices disclosed herein includes a field emission device that includes (a) a cathode assembly, (b) an anode and (c) an evacuated space between the cathode assembly and the anode; wherein the evacuated space includes a protecting vapor that has within the evacuated space a partial pressure greater than about $10^{-8}$ Torr at 20° C.

Figure 1:
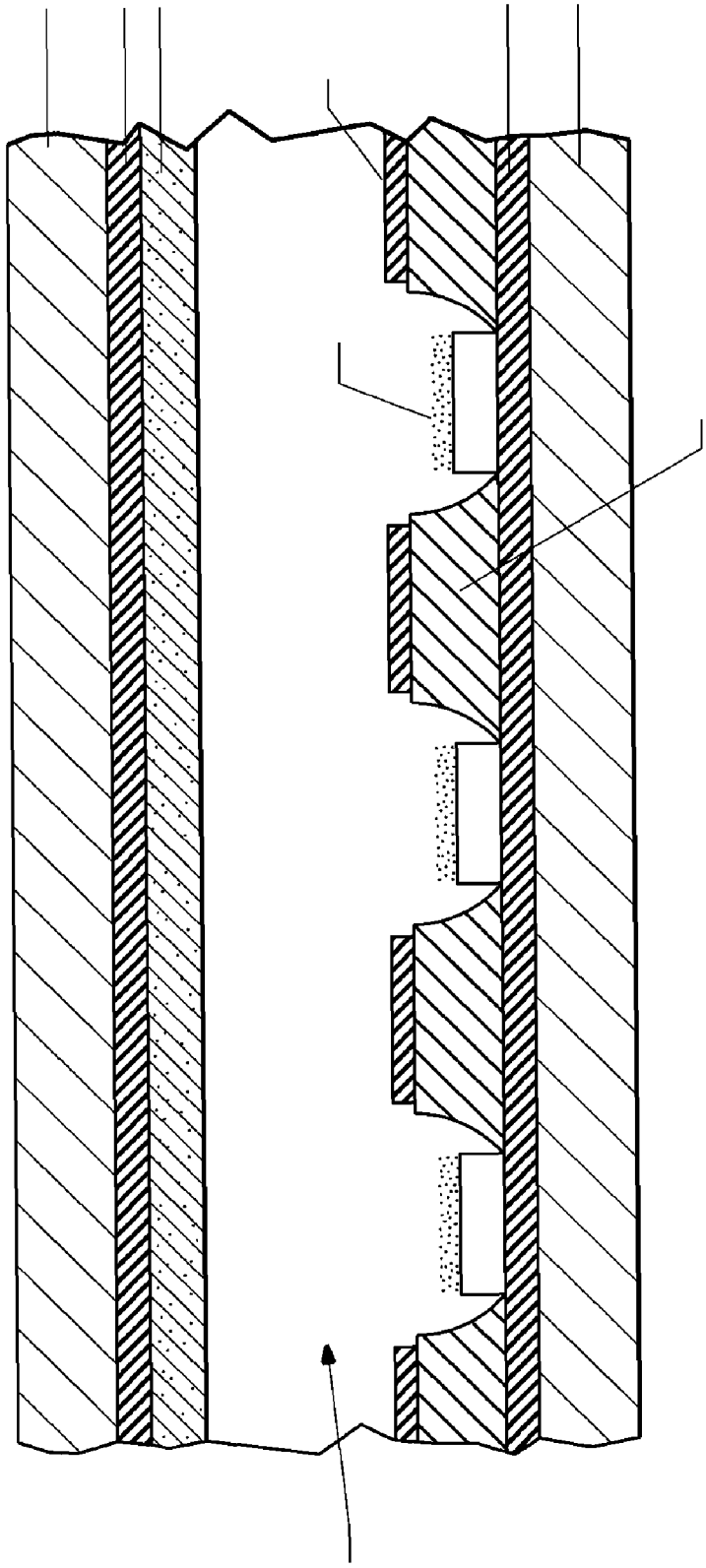
FIG. 1 shows a diagram of a field emission device.
Figure 2:
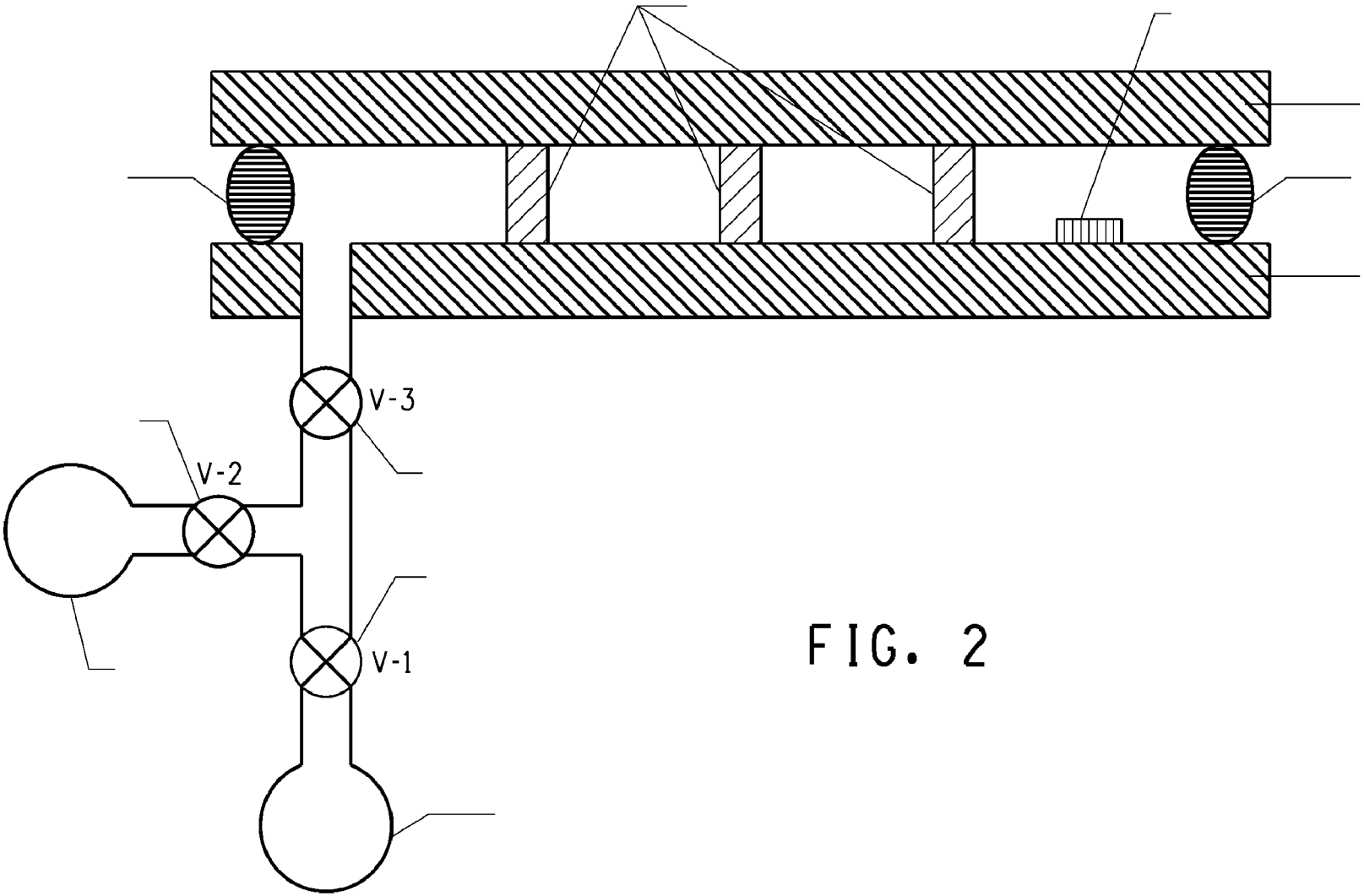
FIG. 2 shows a diagram of a system to introduce hydrocarbon vapor into the evacuated space between the cathode and the anode.

Yet another embodiment of the inventions hereof is an apparatus or device substantially as shown or described in either or both of FIGS. 1~2.

DETAILED DESCRIPTION

This invention addresses the undesirably short lifetime/lifespan that is frequently seen in field emission devices, in particular those devices that employ carbon nanotubes as an electron emitting material. It has been found that various conditions in a field emission device, such as the presence of water vapor, can increase the rate of degradation of the emission current strength of the device, and that decreasing the quantity of a contaminant such as water vapor present can decreases the rate at which emission current strength degrades. A carbon coating on the anode, for example, could be used in an effort to decrease the rate of degradation rate of emission current strength, and would be expected to have such effect presumably because it would be able to react with water molecules, radicals and ions that would otherwise react with nanotubes in the emitter and thus cause emission current strength degradation.

In this invention, however, a protecting vapor is introduced into a field emission device to decrease the rate of degradation of emission current strength. Introduction of a protecting vapor into the device is found to not only decrease the rate of degradation of emission current strength, but in some cases the rate of degradation is actually reversed such that there is an enhancement of emission current strength.

A protecting vapor as used herein includes a hydrogen-containing gas, such as one or more gases containing M—H bonds where M may be selected from any one or more of C, Si, B, Al and P; which would thereby provide gases containing any one or more of C—H, Si—H, B—H, Al—H or P—H bonds. Representative examples of gases suitable for use herein as a protecting vapor include without limitation one or more of a hydrocarbon such as methane, ethane, ethylene, acetylene, propane, propylene or propyne; a substituted hydrocarbon such as methanol, ethanol, n- and iso-propanol or dimethylether; a silane such as silane, methylsilane, dimethylsilane, trimethylsilane, tetramethylsilane, hexamethyldisiloxane or hexamethyldisilazane; a borane such as diborane, methylborane, dimethylborane, trimethylborane, tetramethyldiboroxane or tetramethyldiborazane; an alane such as alane, methylalane, dimethylalane, trimethylalane, tetramethyldialuminoxane or dimethylmethoxyalane; or a phosphine such as phosphine, methylphosphine or trimethylphosphine.

A protecting vapor for use herein may be any one or more of all the members of the total group of protecting vapors disclosed above. The protecting vapor may also, however, be any one or more of those members of a subgroup of the total group of protecting vapors disclosed above, where the subgroup is formed by excluding any one or more other members from the total group. As a result, the protecting vapor in such instance may not only be any one or more of the protecting vapors in any subgroup of any size that may be selected from the total group of protecting vapors in all the various different combinations of individual members of the total group, but the members in any subgroup may thus be selected and used in the absence of one or more of the members of the total group that have been excluded to form the subgroup. The subgroup formed by excluding various members from the total group of protecting vapors may, moreover, be an individual member of the total group such that that protecting vapor is used in the absence of all other members of the total group except the selected individual member.

Among the hydrogen-containing gases, hydrogen itself is less preferred for use as a protecting vapor. In alternative embodiments, moreover, the protecting vapor does not contain any oxygen. Carbon dioxide, for example, is less preferred for use as a protecting vapor.

The methods hereof may be employed in the production of a device hereof, which may for example be a field emission device useful in an electronic display. One embodiment of a field emission device is shown in FIG. 1. A field emission device typically contains a cathode assembly containing an electron emitting material, which may be an acicular emitting material such as carbon nanotubes ("CNTs"). In a preferred embodiment, the electron emitting material excludes molybdenum. The cathode assembly has a substrate prepared from a material such as glass or ceramic. The substrate is coated with a layer of an electronic conductor such as indium tin oxide. A dielectric material is deposited on the electronic conductor layer and patterned to form holes in the dielectric material.

Numerous configurations of a field emitter cathode are possible. The patterning is usually done by photoimaging and developing a photoresist layer which can then act as an etch mask for the dielectric material. The holes may be formed in the dielectric using a wet etch. Frequently, a conductive gate electrode is deposited on the dielectric material prior to etching the holes. This may be done using traditional thin film deposition techniques such as physical vapor deposition (PVD) or thermal evaporation. The gate electrode can be patterned by photoimaging and developing a photoresist layer which will act as a mask in a subsequent wet etch.

A thick film paste containing an emitting material is then typically printed on the dielectric layer comprising the holes. The thick film paste typically contains, in addition to an electron emitting material such as carbon nanotubes, organics to aid printability and optionally glass or ceramic particles, and/or metal powders to increase electrical conductivity. The thick film paste also frequently contains photoimageable constituents to allow patterning. To form a thick film paste deposit in the hole in the dielectric material, the substrate is frequently transparent. The thick film paste may be irradiated with light through the substrate such that the thick film paste at the bottom of the hole in the dielectric material is irradiated. The thick film paste is frequently negatively photoimageable so that it becomes insoluble in the developing solution upon irradiation. The irradiated thick film paste is then developed which leaves a deposit of the thick film paste in the bottom of the hole in the dielectric material. Typically the substrate is fired to remove residual organics. If desired, the thick film paste may then be activated according to a process such as outlined in U.S. Ser. No. 02/074,932 (which is by this reference incorporated in its entirety as a part hereof for all purposes), a process that improves the field emission properties.

The anode of the device is an electrode coated with an electrically conductive layer. When the field emission device is used in a display device where the cathode assembly contains an array of pixels of the thick film paste deposits described above, the anode in the display device may contain phosphors to convert incident electrons into light. The substrate of the anode would also be selected to be transparent so that the resulting light could be transmitted.

Between the anode and the cathode is an evacuated space. This evacuated space needs to be under partial vacuum so that the electrons emitted from the cathode may transit to the anode with only a small number of collisions with gas molecules. Frequently the evacuated space is evacuated to a pressure of less than $10^{-5}$ Torr. Despite being evacuated, it is found that the field emission current from an emitting substance usually degrades with time. The voltage applied to the cathode must be continually increased to maintain a selected field emission current for operation of the device. Although this emission degradation is believed to be associated with reaction of the emitting substance with water molecules, ions or radicals present in the evacuated space, the invention is not limited to any particular theory of operation.

In one embodiment of a device hereof, the evacuated space between the cathode and the anode in the field emission device is filled with the vapor of a protecting vapor to a partial pressure greater than about $10^{-8}$ Torr at 20° C., or more particularly a pressure in the range of about $10^{-3}$ Torr ($133.3\times10^{-3}$ Pa) to about $10^{-8}$ Torr ($133.3\times10^{-8}$ Pa) at 20° C. When a protecting vapor is present in the evacuated space of a field emission device, there is less and sometimes no need to continually increase the voltage applied to the field emission cathode to maintain a constant emission current compared to the rate of increase required in the absence of the protecting vapor. The device may also be operated with or without a getter, such as a barium getter.

The method hereof may be performed to produce a device hereof by supplying a protecting vapor to the evacuated space between the cathode assembly and the anode in a field emission device by a system as shown in FIG. 2. In FIG. 2, the space between the cathode assembly and the anode is connected to a "T" fitting through a sealing valve ("V-3"). One port of the "T" fitting is connected to a vacuum pump through a valve ("V-1"). The final port of the fitting is connected to a reservoir of protecting vapor through a valve ("V-2"). The space between the cathode assembly and the anode is evacuated with the valve V-3 and valve V-1 open and valve V-2 closed. After evacuation, valve V-1 is closed, and the valve V-2 is opened to supply protecting vapor to the evacuated space between the cathode and the anode. Protecting vapor is supplied to the evacuated space in an amount such that its partial pressure therein is greater than about $10^{-8}$ Torr at 20° C., or more particularly a pressure in the range of about $10^{-3}$ Torr ($133.3\times10^{-3}$ Pa) to about $10^{-8}$ Torr ($133.3\times10^{-8}$ Pa) at 20° C. A field emission device wherein an evacuated space between the cathode and the anode includes a protecting vapor that has therein a partial pressure greater than about $10^{-8}$ Torr at 20° C., or more particularly a pressure in the range of about $10^{-3}$ Torr ($133.3\times10^{-3}$ Pa) to about $10^{-8}$ Torr ($133.3\times10^{-8}$ Pa) at 20° C., is thus obtained.

In yet other embodiments, the methods of this invention may additionally include steps to incorporate a field emission device as made herein into an electronic device such as a flat panel display (e.g. a computer or television display), a vacuum electronic device, a klystron or a lighting device. For example, the field emission device as made herein may be constructed in the form of a square, rectangle, circle, ellipse or any other desirable shape. The electron emitting material in such case may then be patterned to be uniformly distributed within the selected shape.

Test Results

Test Results 1

A diode field emission device was constructed to investigate the effects of various gas environments on the degradation rate of a CNT field emission device.

Indium tin oxide ("ITO") coated glass was used as the substrate for the cathode. The cathode assembly was made using a thick film paste of CNTs. The thick film paste was patterned on the cathode with a conventional emitter pattern. The patterned cathode assembly was then fired at 420° C. for 30 minutes at peak temperature in a nitrogen atmosphere. Once fired the patterned emission film was fractured to expose field emitters by laminating the panel with an adhesive tape and removing said tape.

Spacers of thickness d=640 μm are then placed on the surface of the cathode assembly, and an anode is placed on top of the spacers to create a diode field emission device. The anode contained a glass substrate coated with a final 200 nm layer of aluminum, which is used to maximize the light output. The sample is then placed within a vacuum system where electrical contact is made to the anode and cathode of the device.

A high voltage pulsed square wave ($V_C$) was applied to the cathode of all samples to establish an emission current. To maintain a fixed current a fixed DC bias is applied to the anode ($V_A$). Degradation of emission directly corresponds to the rate at which the total applied field $[(V_A-V_C)/d]$ increases. As the emitters degrade, a larger electric field is needed to compensate for their degradation, thus the rate of increase of total applied field directly corresponds to the degradation rate. Lower rates of increase in field indicate a lower degradation rate and thus an advantage in the lifespan or lifetime of the field emission device.

Figure 3:
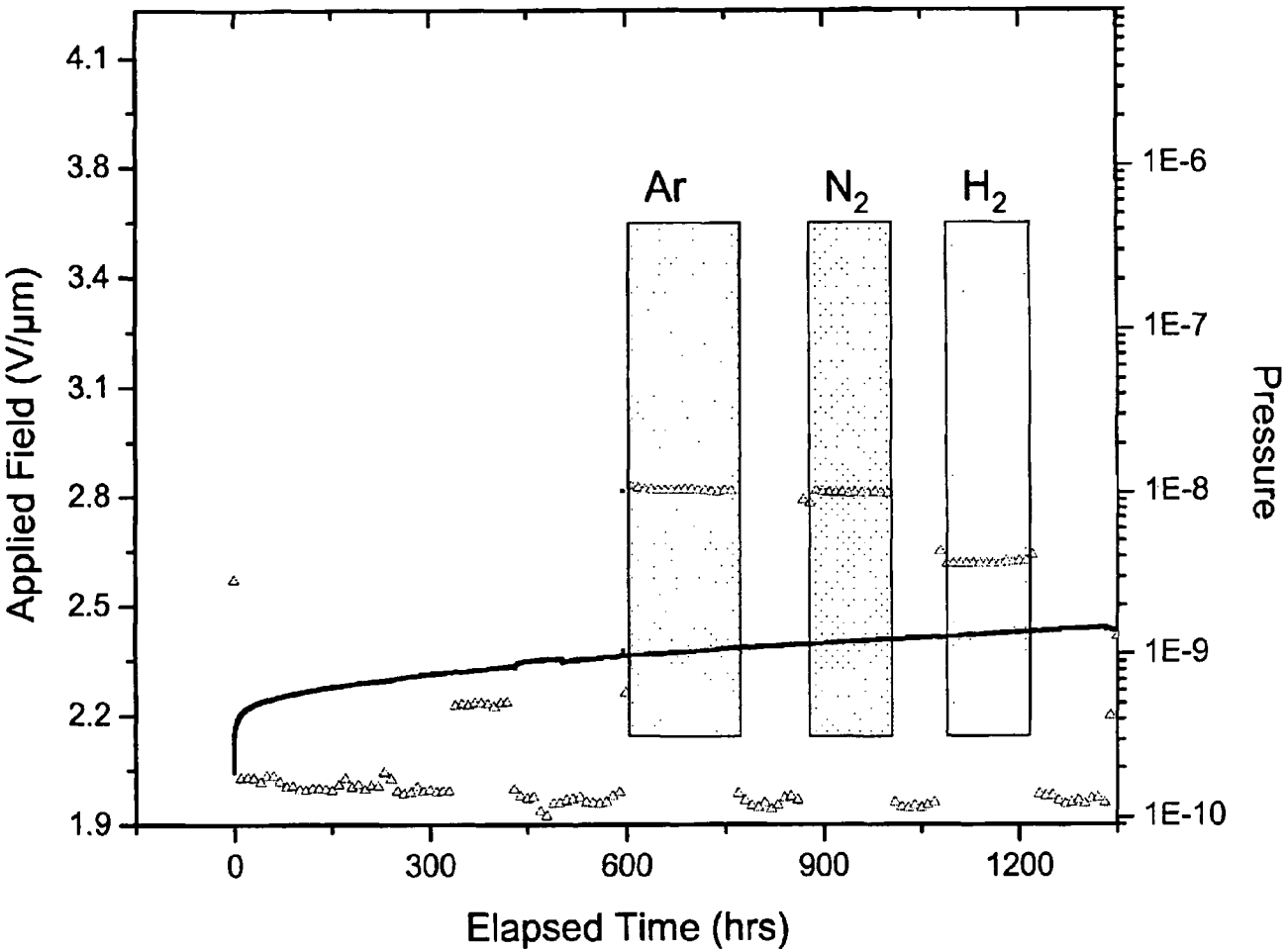
FIG. 3 shows the effect of introduction of argon, nitrogen and hydrogen vapor upon the field emission of a device.

The device was pumped to a base pressure of $1\times10^{-10}$ Torr as measured by a cold cathode gauge. The pressure and applied voltage were monitored as a function of time and are shown in FIG. 3. To calculate the actual pressure of various introduced gasses, their correction factors must be taken into consideration. All gasses were introduced at levels close to the decade levels ($10^{-7}$, $10^{-8}$, $10^{-9}$ etc.) when their various correction factors are taken into account.

Argon was the first gas to be introduced after a base degradation rate was established in the first 600 hours. Argon was introduced to a partial pressure of $1\times10^{-8}$ Torr for the next 200 hours with no resulting change in the degradation rate. The sample was then returned to a base pressure of $1\times10^{-10}$ Torr for the next 100 hours where the degradation rate remained the same. Thus it was demonstrated that introducing argon had no effect on the degradation rate.

Figure 4:
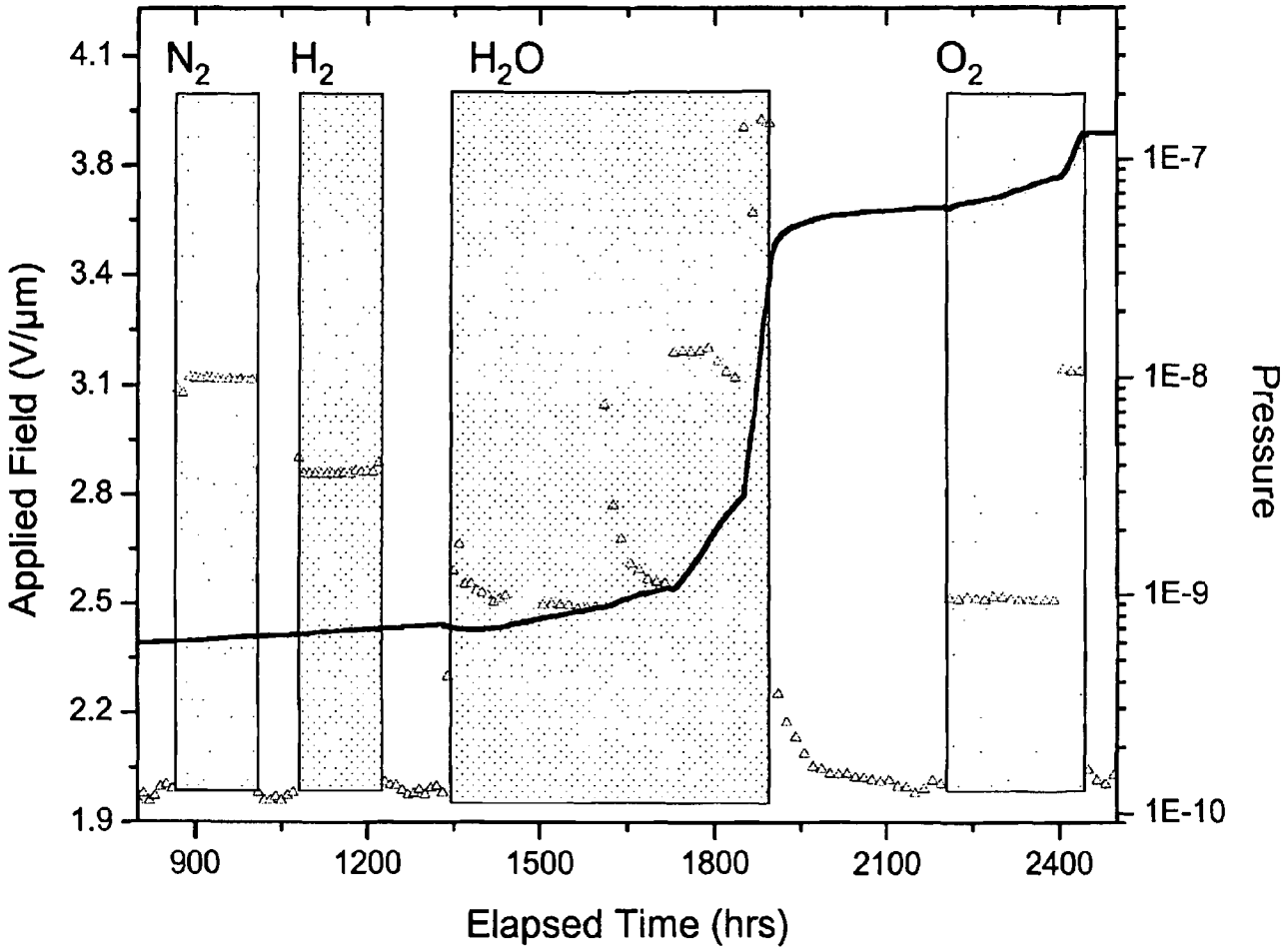
FIG. 4 shows the effect of introduction of water and oxygen vapor upon the field emission of a device.

Following this, the same procedure was followed to examine the effect of $N_2$ and $H_2$ at the same partial pressure of $1\times10^{-8}$ Torr. It was seen that the introduction of Ar, $N_2$ and $H_2$ had no effect on the degradation rate. FIG. 4 contains a continuation of the field and vacuum data for this device.

At 1,350 hours, $H_2O$ was introduced to a partial pressure of $1\times10^{-9}$ Torr. Even at this low partial pressure, it was seen to cause an increase in the degradation rate. Water vapor was introduced at higher partial pressures of $1\times10^{-8}$ Torr and $1\times10^{-7}$ Torr, and was seen at higher vapor pressure to increase the degradation rate further still.

The vacuum level was then returned to a base level of $1\times10^{-8}$ Torr to check the base degradation rate which remained the same. Oxygen was introduced to pressures of $1\times10^{-9}$ and $1\times10^{-8}$ Torr, and was also seen to increase the degradation rate.

Figure 5:
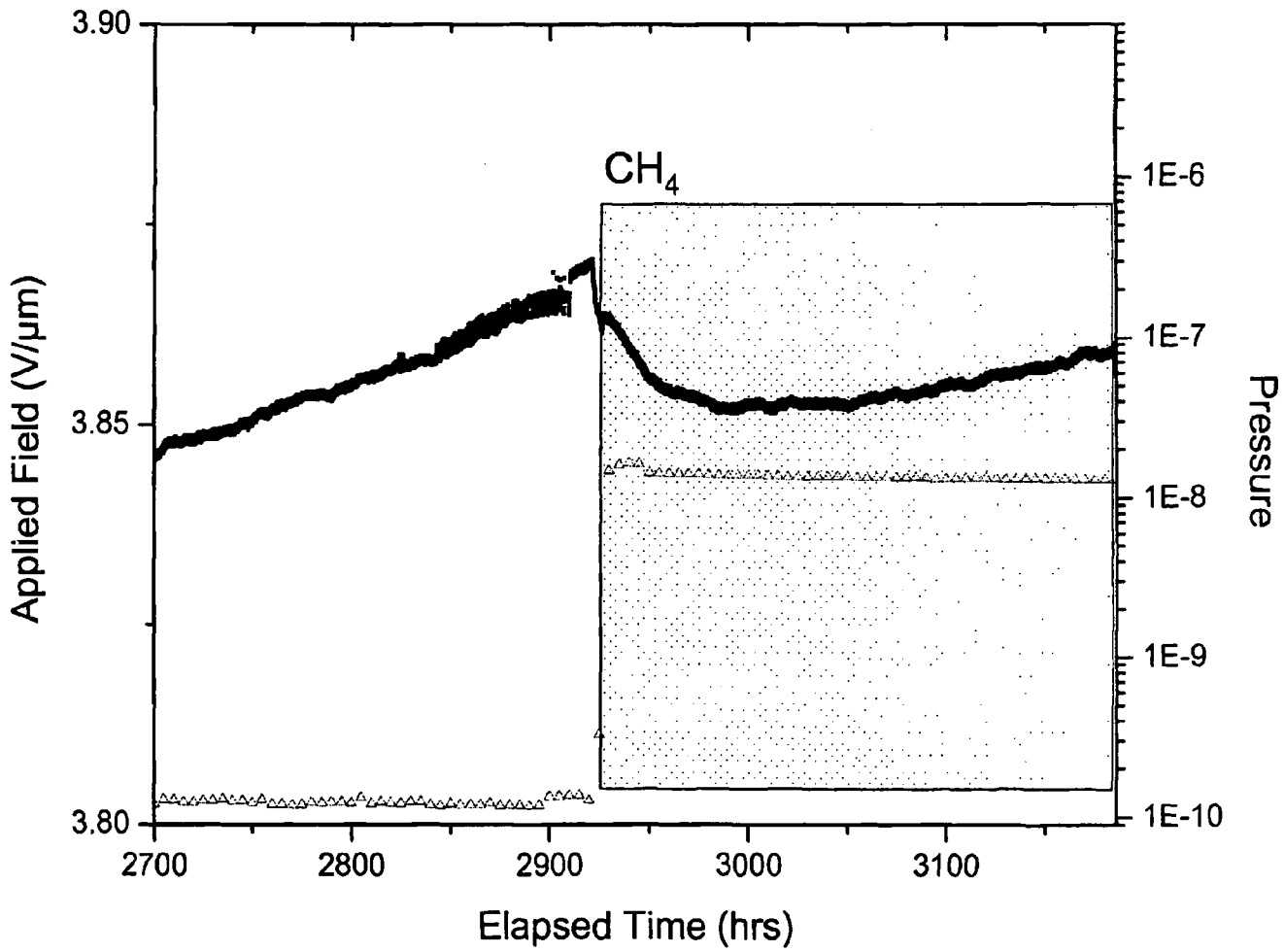
FIG. 5 shows the effect of introduction of hydrocarbon vapor upon the field emission of a device.

FIG. 5 shows the final gas that was introduced, methane ($CH_4$). The base degradation rate for $1\times10^{-10}$ Torr was reestablished for 200 hours starting at 2,700 hours elapsed time. When methane was introduced, the degradation rate was seen to temporarily reverse itself before settling at a lower rate. It is clear in this instance that the introduction of a protecting vapor in the form of a hydrocarbon gas caused a decrease in the degradation rate and thus increase in the lifetime of a CNT based field emission device.

Test Results 2

Figure 6:
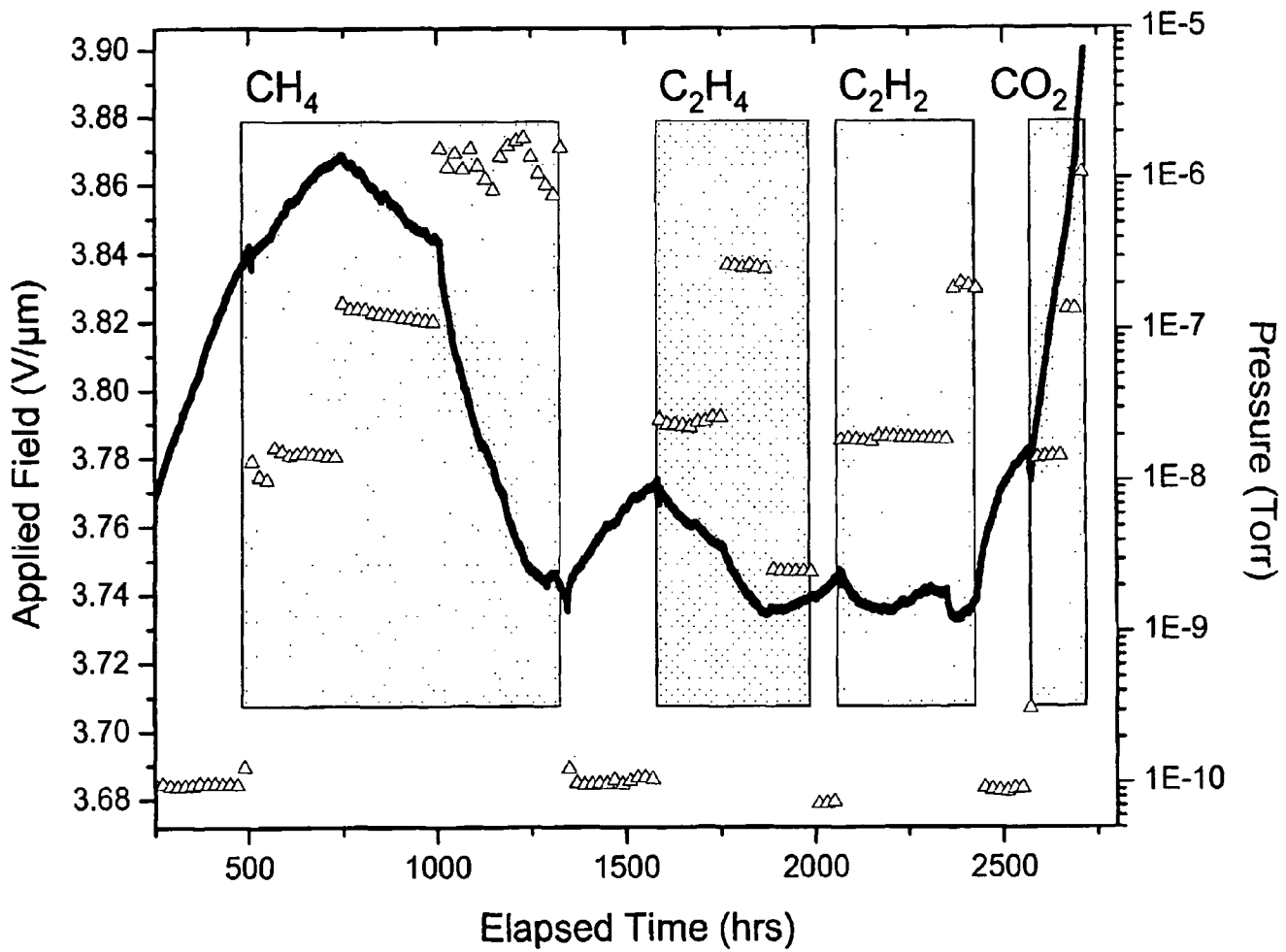
FIG. 6 shows the effect of introduction of various hydrocarbon gasses and carbon dioxide upon the field emission of a device.

A diode field emission device similar to that used in Example 1 was pumped down to a base pressure of $1\times10^{-10}$ Torr. FIG. 6 shows the applied field and chamber pressure as a function of time. A base degradation rate was established in the first 500 hours. Methane ($CH_4$) was introduced to pressures of $1\times10^{-8}$, $1\times10^{-7}$, and $1\times10^{-6}$ Torr. With the introduction of methane, the degradation rate was seen to decrease, and even reverse direction at higher pressures.

The chamber was returned to its base level of $1\times10^{-10}$ Torr to check the base degradation level. Ethylene ($C_2H_4$) was then added at pressure of $1\times10^{-8}$, $1\times10^{-7}$, and $1\times10^{-9}$ Torr. At these pressures, the degradation rate was also seen to slow or reverse direction. The base degradation rate was checked at 2,000 hours elapsed time before introducing acetylene ($C_2H_2$). Acetylene was introduced at pressures of $1\times10^{-8}$ and $1\times10^{-7}$ Torr. The presence of acetylene was also seen to decrease the degradation rate of the field emission device. The device was returned to $1\times10^{-10}$ Torr and a base degradation rate was reestablished. Carbon dioxide ($CO_2$) was then introduced at $1\times10^{-8}$ and $1\times10^{-7}$ Torr. The effect of the carbon dioxide was opposite of the hydrocarbons, the degradation rate increased.

In this specification, unless explicitly stated otherwise or indicated to the contrary by the context of usage, where an embodiment of the subject matter hereof is stated or described as comprising, including, containing, having, being composed of or being constituted by or of certain features or elements, one or more features or elements in addition to those explicitly stated or described may be present in the embodiment. An alternative embodiment of the subject matter hereof, however, may be stated or described as consisting essentially of certain features or elements, in which embodiment features or elements that would materially alter the principle of operation or the distinguishing characteristics of the embodiment are not present therein. A further alternative embodiment of the subject matter hereof may be stated or described as consisting of certain features or elements, in which embodiment, or in insubstantial variations thereof, only the features or elements specifically stated or described are present.

What is claimed is:

1. A method for increasing the lifespan of a field emission device comprising (a) providing a field emission device that comprises (i) a cathode assembly, (ii) an anode, and (iii) an evacuated space between the cathode and the anode; and (b) supplying to the evacuated space a protecting vapor that has, within the evacuated space, a partial pressure greater than about 10-8 Torr at 20° C.;

wherein the protecting vapor is selected from any one or more members of the group consisting of methane, ethane, propane, ethylene, propylene, acetylene and propyne.

2. A method according to claim 1 wherein the cathode assembly comprises an acicular emitting material.

3. A method according to claim 1 wherein the cathode assembly comprises carbon nanotubes.

4. A method according to claim 1 wherein the protecting vapor is selected from any one or more members of the group consisting of a hydrocarbon; a substituted hydrocarbon; a silane; a borane; an alane; and a phosphine.

5. A method according to claim 1 further comprising a step of incorporating the field emission device into an electronic device.

6. A field emission device that comprises (a) a cathode assembly, (b) an anode and (c) an evacuated space between the cathode assembly and the anode; wherein the evacuated space comprises a protecting vapor that has within the evacuated space a partial pressure greater than about 10-8 Torr at 20° C.;

wherein the protecting vapor is selected from any one or more members of the group consisting of methane, ethane, propane, ethylene, propylene, acetylene and propyne.

7. An electronic device comprising a field emission device according to claim 6.

8. A device according to claim 6 wherein the cathode assembly comprises an acicular emitting material.

9. A device according to claim 6 wherein the cathode assembly comprises carbon nanotubes.

10. A device according to claim 6 wherein the protecting vapor is selected from any one or more members of the group consisting of a hydrocarbon; a substituted hydrocarbon; a silane; a borane; an alane; and a phosphine.

* * * * *